US009251946B2

(12) United States Patent
Sato et al.

(10) Patent No.: US 9,251,946 B2
(45) Date of Patent: Feb. 2, 2016

(54) COMPACT

(75) Inventors: Atsushi Sato, Itami (JP); Masato Uozumi, Itami (JP); Koji Yamaguchi, Osaka (JP); Kazushi Kusawake, Itami (JP)

(73) Assignees: Sumitomo Electric Industries, Ltd., Osaka-shi, Osaka (JP); Sumitomo Electric Sintered Alloy, Ltd., Takahashi-shi, Okayama (JP)

( * ) Notice: Subject to any disclaimer, the term of this patent is extended or adjusted under 35 U.S.C. 154(b) by 126 days.

(21) Appl. No.: 14/234,611

(22) PCT Filed: Nov. 28, 2011

(86) PCT No.: PCT/JP2011/077320

§ 371 (c)(1),
(2), (4) Date: Jan. 23, 2014

(87) PCT Pub. No.: WO2013/014813

PCT Pub. Date: Jan. 31, 2013

(65) Prior Publication Data

US 2014/0191839 A1 Jul. 10, 2014

(30) Foreign Application Priority Data

Jul. 27, 2011 (JP) ..... 2011-164726

(51) Int. Cl.
*H01F 17/04* (2006.01)
*H01F 27/28* (2006.01)
(Continued)

(52) U.S. Cl.
CPC ..... *H01F 27/255* (2013.01); *H01F 1/24* (2013.01); *H01F 3/08* (2013.01); *H01F 37/00* (2013.01); *H01F 41/0246* (2013.01)

(58) Field of Classification Search
CPC ... H01F 30/16; H01F 17/045; H01F 27/2847; H01F 3/10; H01F 30/10
USPC ..... 336/221, 233, 232
See application file for complete search history.

(56) References Cited

U.S. PATENT DOCUMENTS 5,587,694 A * 12/1996 Minato et al. ..... 336/65
8,427,271 B2 * 4/2013 Nakatsu et al. ..... 336/212
(Continued)

FOREIGN PATENT DOCUMENTS

CN 1161100 A 10/1997
EP 1129802 9/2001
(Continued)

OTHER PUBLICATIONS

Extended European Search Report in European Patent Application No. 11869911.5, dated Feb. 5, 2015.
(Continued)

*Primary Examiner* — Elvin G Enad
*Assistant Examiner* — Kazi Hossain
(74) *Attorney, Agent, or Firm* — Venable LLP; Michael A. Sartori; Laura G. Remus

(57) ABSTRACT

A compact 10 is obtained by compression-molding coated soft magnetic particles covered with insulating coatings, and is a modified frustum body having, as a main body, a frustum portion 113 sandwiched between plate-shaped portions 111 and 112 arranged in opposing relation. A vertical cross-section of the compact 10 is made up of a trapezoidal surface 113*s*, a long-side rectangular surface 111*s* joining to a long side of the trapezoidal surface 113*s*, and a short-side rectangular surface 112*s* joining to a short side of the trapezoidal surface 113*s*.

8 Claims, 6 Drawing Sheets

3:31, 32

(51) Int. Cl.

| | |
|---|---|
| ***H01F 27/24*** | (2006.01) |
| ***H01F 27/255*** | (2006.01) |
| ***H01F 1/24*** | (2006.01) |
| ***H01F 3/08*** | (2006.01) |
| ***H01F 37/00*** | (2006.01) |
| ***H01F 41/02*** | (2006.01) |

(56) References Cited

U.S. PATENT DOCUMENTS

| | | | | |
|---|---|---|---|---|
| 2003/0024418 | A1 | 2/2003 | Hinzpeter et al. | |
| 2010/0321146 | A1* | 12/2010 | Zhang et al. | 336/229 |
| 2011/0025444 | A1* | 2/2011 | Sugiyama et al. | 336/212 |
| 2011/0156853 | A1* | 6/2011 | Kato et al. | 336/192 |

FOREIGN PATENT DOCUMENTS

| | | | | |
|---|---|---|---|---|
| EP | 1277564 | A2 | | 1/2003 |
| JP | 04-168201 | | | 6/1992 |
| JP | 06-055297 | | | 3/1994 |
| JP | 07-173504 | A | | 7/1995 |
| JP | 10-296499 | A | | 11/1998 |
| JP | H11129102 | A | | 5/1999 |
| JP | 2000-144211 | A | | 5/2000 |
| JP | 2006-181650 | A | | 7/2006 |
| JP | 2006-229203 | A | | 8/2006 |
| JP | 2007-201206 | A | | 8/2007 |
| JP | 2008-160020 | A | | 7/2008 |
| JP | 2008160020 | | * | 7/2008 |
| JP | 2009-019254 | A | | 1/2009 |
| WO | WO-2007/141489 | | | 12/2007 |

OTHER PUBLICATIONS

International Search Report in PCT International Application No. PCT/JP2011/077320, dated Feb. 28, 2012.

Notification of Reasons for Rejection in Japanese Patent Application No. 2012-125851, dated Aug. 3, 2015.

Notification of the First Office Action in Chinese Patent Application No. 201180072563.6, dated Sep. 6, 2015.

* cited by examiner

COMPACT

TECHNICAL FIELD

The present invention relates to a compact utilized as a constituent element of a magnetic core provided in a magnetic circuit component such as a reactor, to a rector core, and to a magnetic circuit component including the compact. In particular, the present invention relates to a compact that exhibits a low loss and good productivity.

BACKGROUND ART

A magnetic circuit component including a magnetic core made of a soft magnetic material, such as iron or an iron alloy, and a coil arranged around the magnetic core is utilized in various fields. On example of constituent elements of the magnetic core is a compact. The compact is typically manufactured by filling material powder made of a soft magnetic material, into a molding space, which is defined by a die having a through-hole and a lower punch arranged to close one opening of the through-hole of the die, and then compression-molding the material powder by an upper punch and the lower punch. A compression-molded product drawn out from the die is usually subjected to heat treatment aiming at removal of distortion, etc.

When the above-mentioned magnetic circuit component is used in an alternating current (AC) magnetic field, an iron loss (generally given as the sum of a hysteresis loss and an eddy current loss) occurs in the magnetic core. In particular, when the magnetic circuit component is used at high frequencies of several kHz or higher, the eddy current loss is significantly increased. Therefore, reduction of the eddy current loss is demanded in the magnetic core. In order to reduce the eddy current loss, it is proposed to employ, as material powder, coated powder formed of a metal particle made of a soft magnetic material, such as an iron particle, and covered with an insulating coating over its outer peripheral surface, thus increasing electrical resistance (see Patent Literature (PTL) 1). It is also proposed to perform post-treatment, such as acid treatment, on a compression-molded product to remove a portion (hereinafter called a "bridge portion") where the insulating coatings are damaged due to, e.g., sliding contact between the compression-molded product and an inner peripheral surface of a die and an electrically conductive state is generated because the metal particles are exposed from the insulating coatings and are deformed to come into contact with each other (see PTL 1).

CITATION LIST

Patent Literature

PTL 1: Japanese Unexamined Patent Application Publication No. 2006-229203

SUMMARY OF INVENTION

Technical Problem

Development of a compact exhibiting a low loss and good productivity is demanded.

Recently, a magnetic core having, particularly, a smaller eddy current loss has been demanded with operating frequencies of magnetic circuit components increasing more and more. The eddy current loss can be reduced, as described above, by employing the coated powder as the material of the compact, and by performing the post-treatment, such as acid treatment, to restore the characteristics. However, if friction between the compression-molded product and the inner peripheral surface of the die is large, there is a possibility that, for example, when the compression-molded product is drawn out from the die, the insulating coating may be damaged and the bridge portions may be generated in not only the surface of the compression-molded product in sliding-contact with the inner peripheral surface of the die, but also the inside thereof. The above-mentioned post-treatment has to be sufficiently carried out in order to remove the bridge portions as well, which are present inside the compression-molded product. As a result, the treatment time is prolonged and productivity of the compact is reduced. Moreover, if many bridge portions are present, there is a possibility that those bridge portions cannot be completely removed by the post-treatment and the compact having a low loss cannot be obtained in some cases.

Accordingly, one object of the present invention is to provide a compact that exhibits a low loss and good productivity. Another object of the present invention is to provide a reactor core and a magnetic circuit component, each of which exhibits a low loss and good productivity.

Solution to Problem

Shortening of a time of post-treatment carried out to restore the characteristics, reduction in the amount of bridge portions to be removed, and reliable removal of the bridge portions can be achieved by suppressing the generation of the bridge portions. An effective solution for reducing the bridge portions is to reduce or preferably to prevent the damage of the insulating coatings. As a result of conducting various studies, the inventors have found that a compact exhibiting a low loss can be obtained by forming the compact in a particular shape even when the time of the post-treatment carried out on a compression-molded product drawn out from a die is relatively short. The reason is presumably in that, for example, when the compression-molded product is drawn out from the die, the insulating coatings are less damaged. Based on such finding, the present invention proposes the compact having the particular shape.

The present invention provides a compact obtained by compression-molding coated soft magnetic particles covered with insulating coatings, wherein the compact has, as at least a part of a cross-section thereof, a surface comprising a trapezoidal surface having a long side and a short side opposing to each other, a long-side rectangular surface joining to the long side of the trapezoidal surface, and a short-side rectangular surface joining to the short side of the trapezoidal surface. Furthermore, in the compact of the present invention, an area of the trapezoidal surface is larger than a total area of the long-side rectangular surface and the short-side rectangular surface.

The compact of the present invention is a solid body in which a cross-sectional area taken along a cross-section parallel to an arbitrary plane constituting an outer surface of the solid body is not uniform unlike a rectangular parallelepiped or a circular column, and which includes portions having different cross-sectional areas.

In more detail, the compact of the present invention includes a portion in which the trapezoidal surface having a trapezoidal shape in a cross-section, as described above, has a large proportion, typically a portion mainly comprising a solid body, e.g., frustum body constituted by the above-mentioned trapezoidal surface. Such a solid body has an outer peripheral surface that is mainly constituted by an inclined surface (i.e., a surface constituting an oblique side of the trapezoidal surface) crossing a direction in which the compact is drawn out from the die, and friction in contact with the inner peripheral surface of the die can be reduced in comparison with that in the case of a solid body having an outer peripheral surface parallel to the direction of the drawing-out from the die as in the solid body being a rectangular parallelepiped or a circular column. Accordingly, in at least the frustum portion of a compression-molded product drawn out from the die, regions of the insulating coatings undergoing damage are reduced and the damaged coating regions can be restricted only to, e.g., just surface regions of the compression-molded product, whereby the generation of the bridge portions can also be reduced. In the compact of the present invention, the post-treatment to remove the bridge portions can be omitted, and the treatment time can be shortened. Furthermore, since the generation of the bridge portions is reduced and the amount of bridge portions to be removed can be reduced, reduction of the yield can also be suppressed with the compact of the present invention. Thus, the compact of the present invention exhibits good productivity. Moreover, since the bridge portions can be sufficiently removed in spite of the post-treatment time being relatively short, a magnetic core and a reactor, each exhibiting a low loss, can be obtained by employing the compact of the present invention. Accordingly, the compact of the present invention can contribute to realizing the magnetic core and the reactor each exhibiting a low loss.

The compact of the present invention includes the long-side rectangular surface and the short-side rectangular surface sandwiching the trapezoidal surface. By employing a solid body having a rectangular surface in a cross-section, typically a columnar body having a pair of opposing surfaces with the same area, e.g., a rectangular parallelepiped or a circular column, as a portion to be arranged perpendicularly to a pressing applied direction during the compression molding, typically as a portion for bearing pressure applied during the compression molding, the compact of the present invention can be stably molded with good dimension accuracy even when the compact includes the portion mainly comprising the frustum body as mentioned above. This point also contributes to giving the compact of the present invention with good productivity.

In addition, with the compact of the present invention, since the friction between the compression-molded product and a forming mold is reduced and a wear of the mold is reduced, the lifetime of the mold can be prolonged.

In a typical embodiment of the compact of the present invention, assuming that a boundary surface between the trapezoidal surface and the long-side rectangular surface is a first surface and a boundary surface between the trapezoidal surface and the short-side rectangular surface is a second surface, each of a surface (surface constituting a side of the long-side rectangular surface parallel to the long side of the trapezoidal surface) parallel to the first surface and a surface (surface constituting a side of the short-side rectangular surface parallel to the short side of the trapezoidal surface) parallel to the second surface constitutes an outer surface of the compact, and the compact mainly comprises the above-mentioned frustum body. In another embodiment, the compact includes a portion joining to the long-side rectangular surface. In such an embodiment, the surface parallel to the second surface constitutes an outer surface of the compact, and a boundary surface between the long-side rectangular surface and the joining portion is an imaginary surface parallel to the first surface. Furthermore, a surface of a part of the joining portion constitutes an outer surface of the compact, and the compact mainly comprises the above-mentioned the frustum body.

In one embodiment of the compact of the present invention, assuming that a boundary surface between the trapezoidal surface and the long-side rectangular surface is a first surface and a boundary surface between the trapezoidal surface and the short-side rectangular surface is a second surface, the compact is molded such that a direction perpendicular to at least one of the first surface and the second surface is a pressing direction.

In the above-mentioned embodiment, during the molding, the first surface and/or the second surface constituting the frustum body is arranged perpendicularly to the pressing direction, an outer peripheral surface (i.e., a surface constituting an oblique side of the trapezoidal surface) constituting the frustum body is positioned, for example, to be molded by the inner peripheral surface of the die. By employing the above-mentioned embodiment, therefore, it is possible to reduce the friction in contact with the inner peripheral surface of the die as described above, to reduce the damage of the insulating coatings, and to manufacture the low-loss compact with good productivity.

In one embodiment of the compact of the present invention, a surface parallel to the first surface and a surface parallel to the second surface are both press-molded surfaces.

The press-molded surface is a surface mainly molded by an upper punch or a lower punch, and it constitutes an outer surface of the compact. Therefore, the above-mentioned embodiment can be said as being an embodiment in which both the surface parallel to the first surface and the surface parallel to the second surface constitute outer surfaces of the compact. Because the trapezoidal surface is present in a state sandwiched between two rectangular surfaces, i.e., the long-side rectangular surface and the short-side rectangular surface, the above-mentioned embodiment can also be said as being an embodiment in which a portion having a cross-section constituted by a trapezoidal surface (i.e., a frustum portion) is sandwiched between the press-molded surfaces. Thus, in the above-mentioned embodiment, an outer peripheral surface of the portion constituted by the trapezoidal surface (i.e., the frustum portion) is positioned to be molded by the inner peripheral surface of the die. It is hence possible to reduce the damage of the insulating coatings, and to manufacture the low-loss compact with good productivity, as mentioned above.

In one embodiment of the compact of the present invention, the portion having the trapezoidal surface is employed at a location at which a tubular coil is arranged. In such an embodiment, preferably, a surface constituting an oblique side of the trapezoidal surface is arranged to face an inner peripheral surface of the coil.

The surface constituting the oblique side of the trapezoidal surface is typically the outer peripheral surface of the frustum body. In the aforesaid surface, as described above, the damage of the insulating coatings is reduced, the insulating coatings are present in a sound state, and the soft magnetic particles are insulated from each other by the insulating coatings. When the aforesaid surface is subjected to the above-described post-treatment, the bridge portions are removed, and the soft magnetic particles are insulated from each other by the insulating coatings. Therefore, the aforesaid surface has high electrical resistance (surface resistance). In the above-mentioned embodiment, the eddy current loss can be effectively reduced by arranging the aforesaid surface having good electrical insulation property to face the inner peripheral surface of the coil.

In one embodiment of the compact of the present invention, assuming that a boundary surface between the trapezoidal surface and the long-side rectangular surface is a first surface and a boundary surface between the trapezoidal surface and the short-side rectangular surface is a second surface, a ratio of an area of the second surface to an area of the first surface is 80% or more and 99.8% or less. In another embodiment of the compact of the present invention, a taper angle formed by the oblique side of the trapezoidal surface and an extension line of the short side of the long-side rectangular surface is 0.1° or more and 6° or less.

With the above-mentioned embodiment, by setting the area ratio of the second surface to the first surface and/or the taper angle so as to satisfy the above-mentioned particular range, the damage of the insulating coatings can be reduced while an area of a magnetic path is sufficiently ensured. Accordingly, the above-mentioned embodiment has not only comparable magnetic characteristics, but also lower loss and better productivity in comparison with the case of employing a solid body having a uniform cross-sectional area, like a rectangular parallelepiped or a circular column, particularly at a location at which the tubular coil is arranged. In the above-mentioned embodiment, both the area ratio and the taper angle may satisfy the above-mentioned particular ranges. When a side of the long-side rectangular surface parallel to the long side of the trapezoidal surface has the same length as that long side and a side of the short-side rectangular surface parallel to the short side of the trapezoidal surface has the same length as that short side, the area of the first surface and the area of the surface parallel to the first surface are substantially the same, and the area of the second surface and the area of the surface parallel to the second surface are substantially the same. Accordingly, when the surface parallel to the first surface and the surface parallel to the second surface constitute the outer surfaces of the compact, the area of the first surface can be utilized as the area of the surface parallel to the first surface, and the area of the second surface can be utilized as the area of the surface parallel to the second surface. Stated in another way, the area of the first surface can be utilized as the cross-sectional area of a cross-section cut at the boundary between the trapezoidal surface and the long-side rectangular surface, and the area of the second surface can be utilized as the cross-sectional area of a cross-section cut at the boundary between the trapezoidal surface and the short-side rectangular surface. In addition, the projection area resulting from projecting the frustum body in its axial direction can also be utilized.

The compact of the present invention can be suitably employed as a constituent element of a magnetic core in a reactor. Accordingly, in one proposed embodiment of a reactor core of the present invention, the reactor core includes the compact of the present invention. Furthermore, in one proposed embodiment of a magnetic circuit component of the present invention, the magnetic circuit component includes the compact of the present invention. The magnetic circuit component of the present invention includes a magnetic core and a tubular coil arranged in a part of the magnetic core. The magnetic core includes an inner core portion arranged in the coil, and an exposed core portion exposed from the coil and forming a closed magnetic path in cooperation with the inner core portion. The inner core portion includes the above-described compact of the present invention. The magnetic circuit component of the present invention is typically a reactor.

Since the low-loss magnetic core can be obtained by employing the compact of the present invention as described above, the reactor core of the present invention, employing the compact of the present invention, and the magnetic circuit component of the present invention, employing the compact of the present invention or the reactor core of the present invention, also exhibit a low loss. Moreover, since the compact of the present invention exhibits good productivity as described above, the reactor core of the present invention and the magnetic circuit component of the present invention, each employing the compact of the present invention as a constituent element, also exhibits good productivity.

The compact of the present invention, having the above-described particular shape, might be manufactured, for example, by carrying out mechanical processing, e.g., cutting, on the compression-molded product that has been molded into an appropriate shape. However, the cutting breaks the insulating coatings. In view of such a point, the compact of the present invention is preferably manufactured by a manufacturing method, described below, which employs a forming mold having a particular shape. The manufacturing method includes the steps of filling coated soft magnetic powder covered with an insulating coating into a molding space that is defined by a through-hole formed in a die and a first punch inserted into the through-hole, and compression-molding the powder by the first punch and a second punch inserted into the through-hole, thereby fabricating the compact. When looking at a cross-section of the die taken in an axial direction of the through-hole, the die includes linear portions disposed in regions close to openings of the through-hole, and a tapered portion sandwiched between the linear portions and tapering from the side where the second punch is inserted toward the side where the first punch is inserted. The above-mentioned molding space is formed in an extent including the tapered portion.

According to the manufacturing method described above, the die having the particular shape and including the tapered portion is employed, and a part of an outer peripheral surface of the compression-molded product is molded by the tapered portion that defines a part of the molding space. In other words, the manufacturing method enables the compression-molded product, having a part of its outer peripheral surface constituted by an inclined surface, to be molded with the presence of the tapered portion. Since the compression-molded product thus obtained can reduce, as described above, the friction in contact with the inner peripheral surface of the die when it is drawn out from the die, for example, the damage of the insulating coating can be effectively reduced. Moreover, since the obtained compression-molded product includes a portion where the damage of the insulating coating is small, it is possible to omit the post-treatment aiming at, e.g., removal of the bridge portions, or to shorten the treatment time. Accordingly, a compact exhibiting a low loss (typically, the compact of the present invention) can be manufactured with good productivity by employing the manufacturing method described above.

Advantageous Effects of Invention

The compact, the reactor core, and the magnetic circuit component according to the present invention exhibit a low loss and good productivity.

REFERENCE SIGNS LIST

Figure 1A:
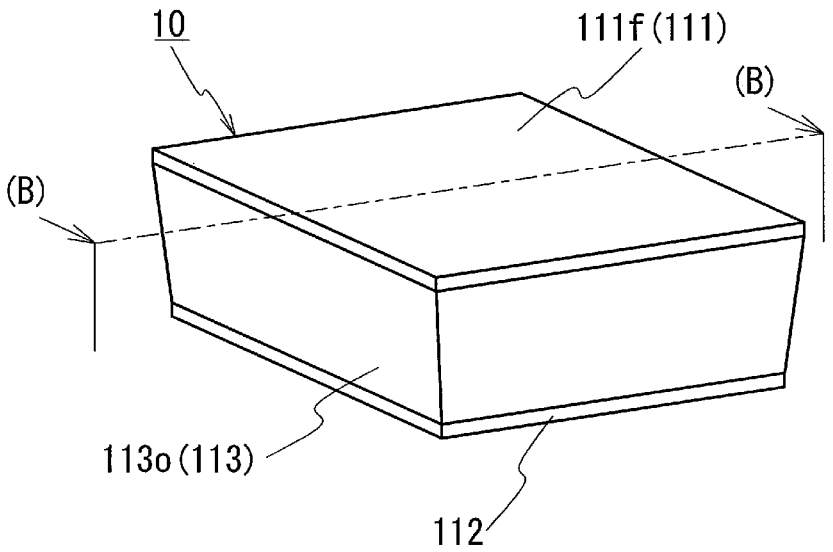
FIG. 1A is an outline perspective view of a compact of Embodiment 1.

1 reactor 2 coil 2*w* wire 2*a*, 2*b* coil elements 2*r* coupling portion
3 magnetic core 31 inner core portion 31*m* core piece 31*g* gap member 32 exposed core portion
10, 11, 12 compacts 111, 112 plate-shaped portions 111*f*, 112*f* press-molded surfaces
111*s* long-side rectangular surface 112*s* short-side rectangular surface
111*o*, 112*o*, 113*o* outer peripheral surfaces
113 frustum portion 113*s* trapezoidal surface
1111, 1112 rectangular surfaces 1113 trapezoidal surface
100, 110, 120, 130, 140 forming molds
101 upper punch 101*p*, 102*p* pressing surfaces
102, 102A, 102B, 102C, 102α, 102β lower punches 103 die 103*h* through-hole
103*i* inner peripheral surface 1011, 1012, 1212, 1411, 1412 linear portions
1013, 1213, 1413 tapered portions 104 core rod
P material powder

DESCRIPTION OF EMBODIMENTS

Embodiments of the present invention will be described below. First, a compact of the present invention is described below with reference to FIGS. 1A, 1B, 1C, 2A and 2B. In the drawings, the same reference sign denotes the same member or part.

Embodiment 1

A compact 10 is a magnetic material that is obtained by compression-molding magnetic powder with a forming mold (typically including a die, an upper punch, and a lower punch), and that is utilized as a constituent element of a magnetic core. The compact 10 is most featured in that it is a solid body analogous to a rectangular parallelepiped, but is a deformed solid body in which a cross-sectional area taken along a cross-section parallel to an arbitrary outer surface of the solid body is not uniform unlike the rectangular parallelepiped, and which includes portions having different cross-sectional areas. The compact 10 will be described in more detail below.

(Compact)

Figure 1B:
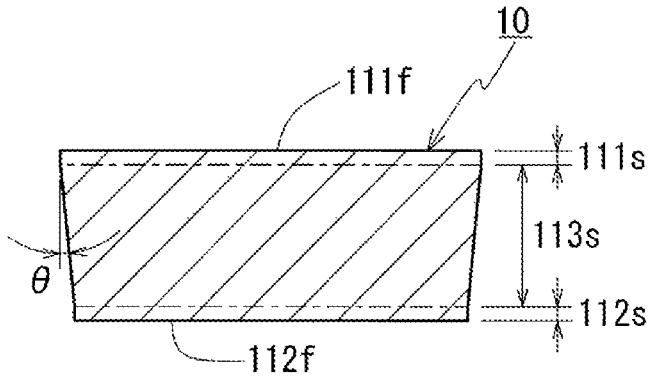
FIG. 1B is a sectional view taken along a line (B)-(B) in FIG. 1A.

The compact 10 is a modified frustum body including plate-shaped portions 111 and 112 arranged in opposing relation, and a frustum portion 113 sandwiched between the plate-shaped portions 111 and 112, the frustum portion 113 constituting a main body. When cutting the compact 10 along a plane extending in a direction from one plate-shaped portion 111 toward the other plate-shaped portion 112 (i.e., along a plane parallel to a direction of thickness of the plate-shaped portions 111 and 112), the cross-section (hereinafter referred to as the "vertical cross-section") is made up of, as illustrated in FIG. 1B, two rectangular surfaces 111*s* and 112*s* arranged in opposing relation, and a trapezoidal surface 113*s* sandwiched between the rectangular surfaces 111*s* and 112*s*. Both the rectangular surfaces 111*s* and 112*s* and the trapezoidal surface 113*s* are smoothly joined to each other. In other words, the rectangular surfaces 111*s* and 112*s* provide respectively a long-side rectangular surface 111*s* joining to a long side of the trapezoidal surface 113*s*, and a short-side rectangular surface 112*s* joining to a short side of the trapezoidal surface 113*s*. The length of each of two opposing sides of the long-side rectangular surface 111*s* is equal to the length of a long side of the trapezoidal surface 113*s*. The length of each of two opposing sides of the short-side rectangular surface 112*s* is equal to the length of a short side of the trapezoidal surface 113*s*. Furthermore, the length of each long side of the short-side rectangular surface 112*s* (=short side of the trapezoidal surface 113*s*) is shorter than each long side of the long-side rectangular surface 111*s*. Thus, the trapezoidal surface 113*s* is tapered toward the short-side rectangular surface 112*s* from the long-side rectangular surface 111*s*.

It is to be noted that, in the drawings, the boundary between the plate-shaped portion and the frustum portion and the inclination of the frustum portion are exaggeratedly illustrated for easier understanding. When the plate-shaped portions are sufficiently smaller in thickness than the frustum portion and a taper angle (described later) is small, the compact appears substantially as a rectangular parallelepiped. Although, in FIGS. 1B, 1C and 2B and FIGS. 5 to 8, 9A and 9B (described later), the boundary between the plate-shaped portion and the frustum portion and the boundary between a linear portion and a tapered portion are each denoted by a one-dot-chain line for easer understanding, the one-dot-chain line is an imaginary line.

The compact 10 is mainly constituted by the frustum portion 113. The expression "mainly" or "a main body" (used later) implies that, when looking at the vertical cross-section of the compact 10, an area S3 of the trapezoidal surface 113*s* constituting the frustum portion 113 is larger than a total area S1+S2 of an area S1 of the long-side rectangular surface 111*s* constituting the plate-shaped portion 111 and an area S2 of the long-side rectangular surface 112*s* constituting the plate-shaped portion 112 (i.e., S3>S1+S2). As described later, the thicknesses (FIG. 1B) of the plate-shaped portions 111 and 112 are preferably as thin as possible in a vertical direction (i.e., as small as possible in size of the vertical cross-section in the cutting direction). Thus, the area S3 of the trapezoidal surface 113*s* is more preferably sufficiently larger than the total area S1+S2 (i.e., S3>>S1+S2). In practice, the area S3 of the trapezoidal surface 113*s* is preferably more than 50% and more preferably 70% or more of the total area S1+S2+S3.

The frustum portion 113 is a frustum body corresponding to respective planar shapes of the plate-shaped portions 111 and 112. An outer peripheral surface 113*o* (i.e., a surface defining an oblique side of the trapezoidal surface 113*s* in the vertical cross-section) of the frustum portion 113 may be a flat surface (corresponding to a liner oblique line of the trapezoidal surface 113*s* in the vertical cross-section) or a curved surface (corresponding to a curved oblique line thereof) (FIG. 1A representing the case of a flat surface). When cutting the frustum portion 113 along a plane parallel to plate surfaces (press-molded surfaces 111*f* and 112*f* described later) of the plate-shaped portions 111 and 112, an area of the cross-section (hereinafter referred to as the "horizontal cross-section") differs depending on a cutting position. A cross-sectional area when cutting the frustum portion 113 along a plane nearer to one plate-shaped portion 111 is larger than that when cutting the frustum portion 113 along a plane nearer to the other plate-shaped portion 112.

The outer peripheral surface 113*o* of the frustum portion 113 is molded by an inner peripheral surface of a die of a forming mold. Accordingly, friction between the outer peripheral surface 113*o* of the frustum portion 113 and the inner peripheral surface of the die can be reduced and the damage of the insulating coating can be effectively reduced by setting an inclination angle of the frustum portion 113, specifically an angle (hereinafter referred to as a "taper angle θ") formed, when looking at the vertical cross-section, by the oblique side of the trapezoidal surface 113*s* (an approximate line, a tangential line, or a chord in the case of the oblique side being a curved line) and an extension line of a short side of the long-side rectangular surface 111*s*, to be 0.1° or more. As the taper angle θ increases, it is easier to suppress the damage of the insulating coating. However, if the taper angle θ is too large, the area of a boundary surface between the frustum portion 113 and the other plate-shaped portion 112 (i.e., the length of the short side of the trapezoidal surface 113*s*) is too small (short), the area of a magnetic path reduces and magnetic characteristics degrades. Accordingly, the taper angle θ is preferably 6° or less. Though depending on the thickness of the frustum portion 113 (i.e., the height of the trapezoidal surface 113*s*), the taper angle θ is more preferably 0.1° or more and 3° ore less and even more preferably 0.1° or more and 2° or less.

When the frustum portion 113 has a form that the taper angle θ is uniform over the entire outer peripheral surface 113*o* thereof, advantages are obtained, for example, in points of effectively reducing the friction between the compression-molded product and the inner peripheral surface of the die, facilitating application of uniform pressing, ensuring good dimensional accuracy, and allowing the mold to have a simpler shape. The frustum portion 113 may have a form that only a part of its outer peripheral surface 113*o* is constituted by an inclined surface. For example, when the frustum portion 113 is a frustum of pyramid, only one of surfaces constituting outer peripheral surfaces of the frustum of pyramid may be an inclined surface. In such a form, when looking at a certain vertical cross-section, oblique sides of a trapezoidal surface in the certain vertical cross-section have different taper angles.

Figure 1C:
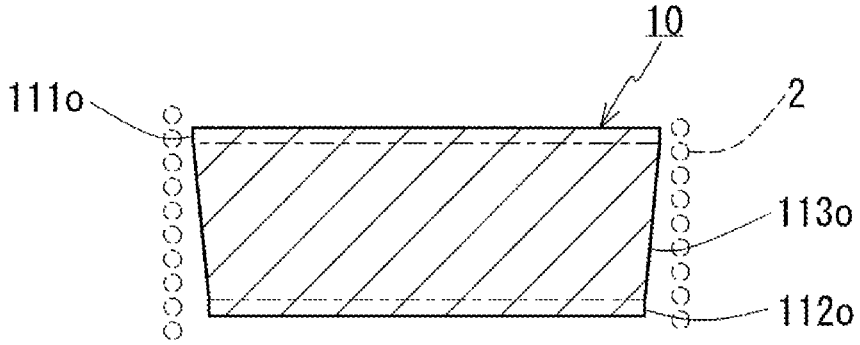
FIG. 1C is a sectional view to explain a state where the compact is arranged in a coil.

The planar shape of each of the plate-shaped portions 111 and 112 may be not only rectangular as illustrated in FIG. 1A, but also circular, elliptical, racetrack-like, a corner-rounded rectangular shape obtained by rounding corners of a rectangle into desired angles, and so on. Such a planar shape is advantageous in that, when the compact 10 is inserted into a tubular coil 2 as illustrated in FIG. 1C, for example, the compact 10 can be positioned close to the coil 2 by forming the compact 10 to have a planar shape corresponding to the inner peripheral shape of the coil 2, and the size of a magnetic component can be reduced. When the planar shape of each of the plate-shaped portions 111 and 112 is rectangular, the compact 10 has a shape of a frustum of pyramid, e.g., a frustum of quadrangular pyramid, and when it is circular or elliptical, the compact 10 has a shape of a frustum of circular or elliptical cone. In the compact 10, the area of the horizontal cross-section in the plate-shaped portion 111 and the area of the horizontal cross-section in the plate-shaped portion 112 are each uniform. Alternatively, the planar shape of each of the plate-shaped portions 111 and 112 may be a circular ring shape having a hole formed therein. In such a case, the compact is a solid body including an annular frustum body.

The plate-shaped portions 111 and 112 are portions directly bearing pressure applied during compression molding. Because of having the plate-shaped portions 111 and 112 that serve as the pressure bearing portions, the compact 10 can be molded at good accuracy even with the frustum portion 113 constituting its main body.

The plate-shaped portions 111 and 112 have press-molded surfaces 111*f* and 112*f* molded by an upper punch and a lower punch, respectively, which are used to apply pressure during the compression molding. Herein, the press-molded surface 111*f* is a surface parallel to the boundary surface between the trapezoidal surface 113*s* and the long-side rectangular surface 111*s*, and it is a surface that constitutes a side of the long-side rectangular surface 111*s*, the side being parallel to the long side of the trapezoidal surface 113*s*. The press-molded surface 112*f* is a surface parallel to the boundary surface between the trapezoidal surface 113*s* and the short-side rectangular surface 112*s*, and it is a surface that constitutes a side of the short-side rectangular surface 112*s*, the side being parallel to the short side of the trapezoidal surface 113*s*.

In a compact, a pressing direction can be determined, for example, based on its shape (such as how corners are rounded), or a deformed state of magnetic particles in a cross-section (generally, particles constituting the compact are plastically deformed in a direction perpendicular to the pressing direction and are flattened). Accordingly, an outer surface of the compact extending in the direction perpendicular to the pressing direction can be determined to be the press-molded surface. Furthermore, an outer surface of the compact positioned between the press-molded surfaces opposing to each other can be typically determined to be a surface (sliding contact surface) that has been molded by the inner peripheral surface of the die. Additionally, the sliding contact surface can also be determined depending on the presence of sliding traces.

The thickness of each of the plate-shaped portions 111 and 112 is preferably as thin as possible within a range where the frustum portion 113 can be molded, and it is thought that about 0.3 mm to 2 mm is a sufficient thickness. Outer peripheral surfaces 111*o* and 112*o* of the plate-shaped portions 111 and 112 are outer peripheral surfaces of the compression-molded product, which are parallel to a direction in which the compression-molded product is drawn out from the die. Therefore, the thinner the thickness of each of the plate-shaped portions 111 and 112, the smaller is the friction between the compression-molded product and the forming mold, and the less is the damage of the insulating coating. Hence the thickness of each of the plate-shaped portions 111 and 112 is preferably 2 mm or less (4 mm or less in total) and more preferably 1 mm or less (2 mm or less in total).

Herein, the area of the press-molded surface 111*f* constituting the long side of the long-side rectangular surface 111*s* is equal to any of the area of the boundary surface between the frustum portion 113 (trapezoidal surface 113*s*) and the plate-shaped portion 111 (long-side rectangular surface 111*s*), the area of the cross-section (horizontal cross-section) cut along the boundary between the frustum portion 113 (trapezoidal surface 113*s*) and the plate-shaped portion 111 (long-side rectangular surface 111*s*), and the projection area of the above-mentioned boundary surface. The area of the press-molded surface 112*f* constituting the long side of the short-side rectangular surface 112*s* is equal to any of the area of the boundary surface between the frustum portion 113 (trapezoidal surface 113*s*) and the plate-shaped portion 112 (short-side rectangular surface 112*s*), the area of the cross-section (horizontal cross-section) cut along the boundary between the frustum portion 113 (trapezoidal surface 113*s*) and the plate-shaped portion 112 (short-side rectangular surface 112*s*), and the projection area of the above-mentioned boundary surface. Because the lengths of the rectangular surfaces 111*s* and 112*s* are different from each other as described above, the areas of the press-molded surfaces 111*f* and 112*f* are also different from each other. Herein, the area of the plate-shaped portion 111 is larger than that of the plate-shaped portion 112. A ratio of the area of the plate-shaped portion 112 having the smaller area to the area of the plate-shaped portion 111 having the larger area changes depending on the thickness of the frustum portion 113 (i.e., the height of the trapezoidal surface 113*s*) and the taper angle θ mentioned above. For example, when the thickness of the frustum portion 113 is constant, the above-mentioned area ratio increases as the taper angle θ decreases. When the taper angle θ is constant, the above-mentioned area ratio increases as the thickness of the frustum portion 113 decreases (as the frustum portion 113 becomes thinner). In the case of employing the plate-shaped portions 111 and 112 as magnetic paths, the above-mentioned area ratio is preferably 80% or more such that a sufficient area of the magnetic paths can be ensured. The larger the above-mentioned area ratio, the larger is the area of the magnetic paths. However, as the above-mentioned area ratio increases, the taper angle θ decreases and the effects of reducing the damage of the insulating coating becomes smaller. For that reason, the above-mentioned area ratio is preferably 99.8% or less. The above-mentioned area ratio is more preferably 88.4% or more and 99.8% or less, and even more preferably 92% or more and 99.8% or less.

(Manufacturing Method)

{Forming Mold}

Figure 2A:
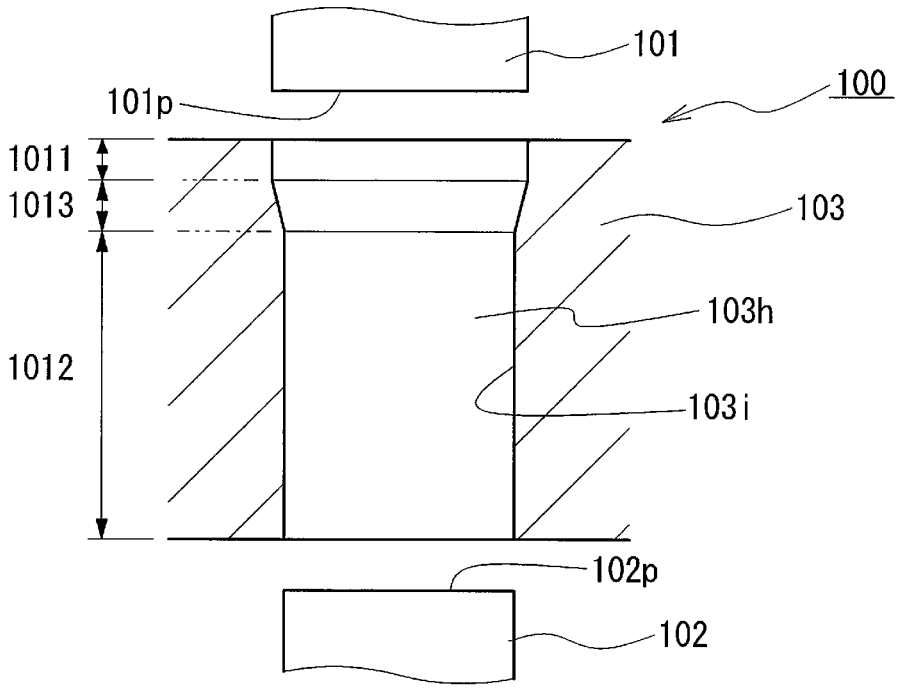
FIG. 2A is a process explanatory view to explain one example of procedures for manufacturing the compact of Embodiment 1.
Figure 2B:
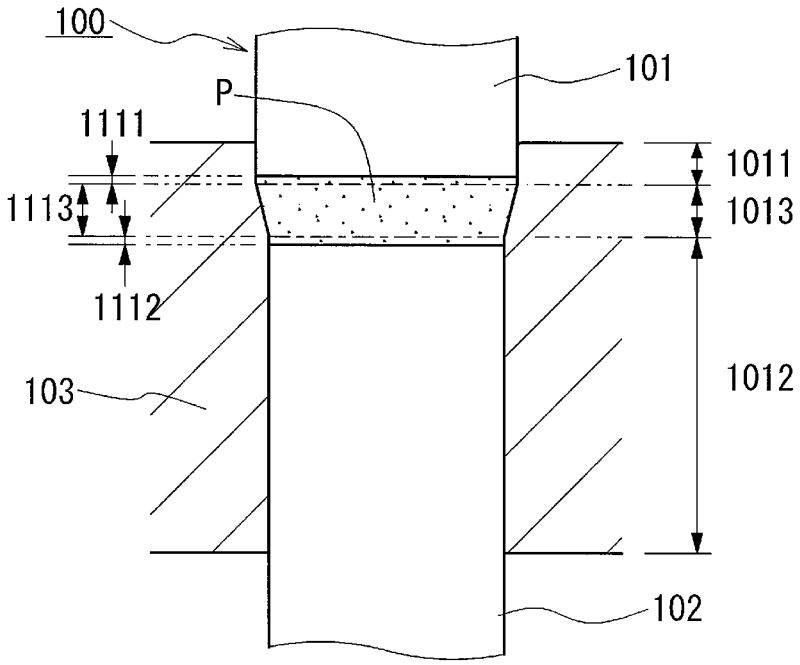
FIG. 2B is a process explanatory view to explain one example of the procedures for manufacturing the compact of Embodiment 1.

The compact 10 having the particular shape described above can be manufactured, for example, by employing a forming mold 100 illustrated in FIGS. 2A and 2B. The forming mold 100 is first described below.

The forming mold 100 includes a tubular die 103 having a through-hole 103*h* formed therein, and a first punch (lower punch 102) and a second punch (upper punch 101) each having columnar shape, which are inserted through openings of the through-hole 103*h* of the die 103 and which are arranged to face each other within the through-hole 103*h*. In the forming mold 100, a tubular space having a bottom and defined by inserting the lower punch 102 into the through-hole 103*h* of the die 103 provides a molding space, and the compact is molded by pressing and compressing the material powder, filled in that space, by the upper punch 101 and the lower punch 102. In the forming mold 100, the through-hole 103*h* of the die 103 has the particular shape.

In the through-hole 103*h* of the die 103, an opening area of one of the openings is different from that of the other opening, and an intermediate portion of the through-hole 103*h* in the axial direction thereof is formed by an inclined surface. More specifically, as illustrated in FIG. 2A, when looking at a cross-section of the through-hole 103*h* taken in an axial direction thereof, the through-hole 103*h* includes linear portions 1011 and 1012 formed in regions close to the openings of the through-hole 103*h*, and a tapered portion 103 formed between the linear portions 1011 and 1012 and tapering from the side where the upper punch 101 is inserted (i.e., from the upper side in FIGS. 2A and 2B) toward the side where the lower punch 102 is inserted (i.e., toward the lower side in FIGS. 2A and 2B). The outer peripheral surface 111*o* of one plate-shaped portion 111 of the compact 10, illustrated in FIGS. 1A, 1B and 1C, is molded by an inner peripheral surface of the die 103, which is constituted by one linear portion 1011, the outer peripheral surface 112*o* of the other plate-shaped portion 112 of the compact 10 is molded by an inner peripheral surface of the die 103, which is constituted by the other linear portion 1012, and the outer peripheral surface 113*o* of the frustum portion 113 of the compact 10 is molded by an inclined surface of the die 103, which is constituted by the tapered portion 1013. The press-molded surfaces 111*f* and 112*f* (FIG. 1B) of the plate-shaped portions 111 and 112 are molded respectively by a surface (pressing surface 101*p* in FIGS. 2A and 2B) of the upper punch 101, the surface opposing to the lower punch, and by a surface (pressing surface 102*p* in FIGS. 2A and 2B) of the lower punch 102, the surface opposing to the upper punch.

Because an angle of the tapered portion 1013 (i.e., a value of an angle formed by an extension line of a linear line defining the one linear portion 1011 and an oblique edge of the tapered portion 1013) is substantially equal to the taper angle θ of the compact 10 (FIG. 1B), the relevant angle is appropriately selected such that the taper angle θ takes a desired value, preferably such that the taper angle θ satisfies the above-described range. Because the length of the through-hole 103*h* in the tapered portion 1013 in the axial direction (i.e., in the up-and-down direction in FIGS. 2A and 2B) is substantially equal to the thickness of the frustum portion 113 (FIG. 1A) of the compact 10, the relevant length is appropriately selected such that the thickness of the frustum portion 113 has a desired value. Because the opening areas of the openings of the through-hole 103*h* and the areas of the pressing surfaces 101*p* and 102*p* of the upper punch 101 and the lower punch 102 are substantially equal to respectively the areas of the plate-shaped portions 111 and 112 (FIG. 1A) (i.e., the areas of the press-molded surfaces 111*f* and 112*f* (FIGS. 1A and 1B), they are appropriately selected such that the areas of the plate-shaped portions 111 and 112 have desired values, preferably such that those areas satisfy the above-described area ratio.

The forming mold 100 can be made of suitable one of high-strength materials (such as high-speed steel) that have been used in molding compacts (mainly comprising metal powder) in the past.

At least one of the upper punch 101 and the lower punch 102, and the die 103 are movable relative to each other. In the forming mold 100 illustrated in FIGS. 2A and 2B, the lower punch 102 is fixed to a main apparatus (not illustrated) to be held immobile, while the die 103 and the upper punch 101 are each movable in the up-and-down direction by a moving mechanism (not illustrated). Alternatively, the arrangement may be modified such that the die 103 is fixed and both the punches 101 and 102 are movable, or that the die 103 and both the punches 101 and 102 are all movable. The arrangement of fixing one (lower punch 102 herein) of the punches is advantageous in that the moving mechanism is simpler and moving operations are easier to control.

The friction between the material powder or the compression-molded product and the forming mold 100 can be reduced by applying a lubricant to the forming mold 100 (particularly, to an inner peripheral surface 103*i* of the die 103). The lubricant may be, for example, one of solid lubricants including metal soap such as lithium stearate, fatty acid amide such as amide stearate, and higher fatty acid amide such as amide ethylene-bis-stearate, dispersion liquids prepared by dispersing the solid lubricants in a solution medium such as water, and liquid lubricants. Additionally, formability can be improved by molding the compact while the mold is held in a heated state (i.e., warm molding). Of course, cold molding may also be practiced.

{Molding Procedures}

Procedures for manufacturing the compact 10 (FIGS. 1A, 1B and 1C) with the forming mold 100 will be described below. The lower punch 102 is inserted into the through-hole 103*h* of the die 103 such that the molding space having a predetermined size is formed by the die 103 and the lower punch 102. The upper punch 101 is moved upward away from the molding space.

Later-described material power, i.e., coated soft magnetic power, is supplied to the molding space by a power feeding apparatus (not illustrated).

The upper punch 101 is moved downward and inserted into the through-hole 103*h* of the die 103, thus pressing and compressing the material powder P by both the punches 101 and 102 (FIG. 2B).

Molding pressure is set to be, for example, 5 ton/cm$^2$ (≈490 MPa) or more and 15 ton/cm$^2$ (≈1470 MPa) or less. By setting the molding pressure to be 5 ton/cm$^2$ or more, the material powder P can be sufficiently compressed and relative density of the compact can be increased. By setting the molding pressure to be 15 ton/cm$^2$ or less, the damage of the insulating coating caused by mutual contact between the coated soft magnetic particles constituting the material powder P can be suppressed. The molding pressure is more preferably 6 ton/cm$^2$ or more and 10 ton/cm$^2$ or less.

After the upper punch 101 comes into contact with the material powder P, the die 103 is also moved downward together with the upper punch 101. Because the die 103 is also moved together with the upper punch 101, it is easier to uniformly apply pressure to the material powder P in the molding space. A moving speed of the die 103 and the upper punch 101 can be selected as appropriate. Alternatively, only the upper punch 101 may be moved.

With the predetermined pressing, a compression-molded product is molded in the molding space as illustrated in FIG. 2B, the compression-molded product having a surface 1111 having a rectangular shape in cross-section and molded by both the upper punch 101 and one linear portion 1011, a surface 1112 having a rectangular shape in cross-section and molded by both the lower punch 102 and the other linear portion 1012, and a surface 1113 having a trapezoidal shape in cross-section, molded by the tapered portion 1013, and sandwiched between both the rectangular surfaces 1111 and 1112. The die 103 is moved downward to take out the compression-molded product.

After the compression-molded product has been completely exposed from the die 103, the upper punch 101 is moved upward and the compression-molded product is taken out. After moving the upper punch 101 upward, the die 103 may be moved downward, or the upper punch 101 and the die 103 may be moved at the same time.

When performing the molding successively, it is preferable to repeat the steps of forming of the molding space→filling of the material powder into the molding space→pressing and compression→taking-out, as described above.

Although the compression-molded product obtained as described above can be used in the state just after the molding, it may be subjected to heat treatment, for example, aiming to remove, e.g., distortion caused by the compression. A loss, such as a hysteresis loss, can be reduced by removing the distortion. Conditions of the heat treatment are set, for example, to heating temperature of about 300° C. to 800° C. and holding time of 30 min or longer and 60 min or shorter. The higher the heating temperature, the easier is removal of the distortion, and the smaller is the hysteresis loss. However, if the heating temperature is too high, there is a risk that the insulating coating may be thermally decomposed and an eddy current loss may be increased. For that reason, the heating temperature is preferably set to be lower than the pyrolysis temperature of the insulating coating. Typically, when the insulating coating is made of an amorphous phosphate, such as iron phosphate or zinc phosphate, the heating temperature is preferably up to about 500° C. When the insulating coating is made of an insulating material having good heat resistance, such as a metal oxide or a silicone resin, the heating temperature can be increased to 550° C. or higher, further to 600° C. or higher, and even further to 650° C. or higher in particular cases. Anyway, the heating temperature and the holding time are appropriately selected depending on the material of the insulating coating. While an atmosphere in which the heat treatment is performed is not limited to particular one, oxidation of soft magnetic particles can be avoided by selecting a non-oxidizing atmosphere such as a nitrogen atmosphere, or a low-oxygen atmosphere having a low oxygen concentration.

The obtained compression-molded product or a heat-treated product after the above-mentioned heat treatment may be subjected to post-treatment, e.g., acid etching, aiming to remove a portion in which the soft magnetic particles are contacted with each other into an electrically conductive state, i.e., the bridge portion. The post-treatment is preferably performed by setting a treatment time and the concentration of a treatment liquid such that, for example, the loss is held not larger than a predetermined value.

Thus, the compact 10 (FIGS. 1A, 1B and 1C) is obtained in the form of the compression-molded product as it is, the heat-treated product, or a post-treated product after the above-mentioned post-treatment.

Figure 5:
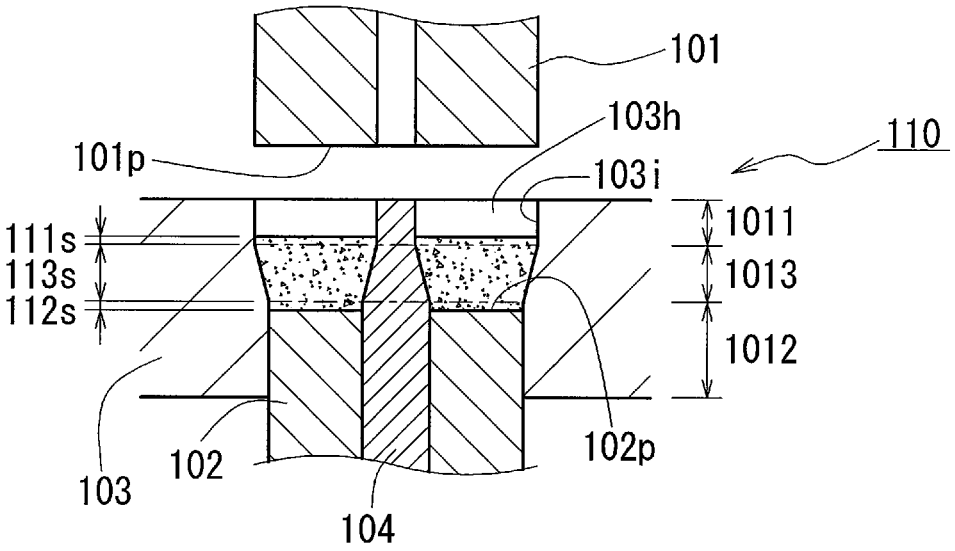
FIG. 5 is an explanatory view to explain one example of a forming mold used in manufacturing an annular compact.
Figure 6:
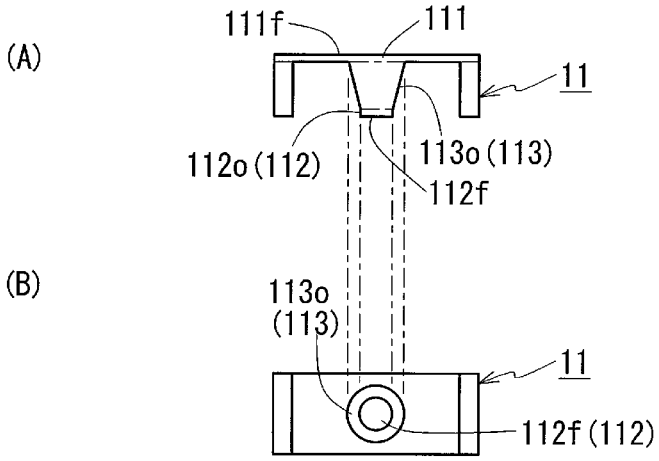
FIG. 6 consists of a portion (A) representing a front view of a compact employed in an ER-type core, and a portion (B) representing a rear view of the compact.

In the case of manufacturing an annular compact, a forming mold 110 may be used, for example, which includes, as illustrated in FIG. 5, a core rod 104 coaxially inserted into a tubular lower punch 102 and being movable relative to the lower punch 102. The above-described tapered portion 1013 is formed in the inner peripheral surface 103*i* of the through-hole 103*h* in the die 103, and an outer peripheral surface of the core rod 104 also has a tapered portion similar to that in the die 103. For example, the core rod 104 used here includes, in a region on the side closer to the upper punch 101, a tapered portion that is tapered reversely to the tapered portion 1013 of the die 103, i.e., a tapered portion tapering toward the upper punch 101. By employing the forming mold 110, it is possible to reduce friction between an inner peripheral surface of a through-hole in the annular compact and an outer peripheral surface of the core rod 104, and to reduce the damage of the insulating coating. In the annular compact thus obtained, a cross-section resulting from cutting the annular compact along a plane, which passes an axis of the through-hole, has such a shape that trapezoidal surfaces 113*s* each sandwiched between a long-side rectangular surface 111*s* and a short-side rectangular surface 112*s* are present symmetrically with the axis of the through-hole being a center.

(Material Powder)

Coated soft magnetic powder including a soft magnetic particle made of a soft magnetic material and an insulating coating formed on the surface of the soft magnetic particle is used as magnetic powder that is material powder of the compact 10 (FIGS. 1A, 1B and 1C).

The soft magnetic material preferably contains 50% by mass or more of a metal, particularly iron. Examples of iron include not only pure iron (Fe), but also one type of iron alloy selected from among a Fe—Si based alloy, a Fe—Al based alloy, a Fe—N based alloy, a Fe—Ni based alloy, a Fe—C based alloy, a Fe—B based alloy, a Fe—Co based alloy, a Fe—P based alloy, a Fe—Ni—Co based alloy, and a Fe—Al—Si based alloy. In particular, the compact made of pure iron, i.e., 99% by mass or more of Fe, provides a magnetic core having high magnetic permeability and high magnetic flux density. The compact made of the iron alloy provides a magnetic core that is easier to reduce the eddy current loss and that exhibits a low loss.

An average particle diameter of the soft magnetic particles is preferably 1 μm or more and 70 μm or less. With the average particle diameter being 1 μm or more, good fluidity can be obtained, and an increase of the hysteresis loss can be suppressed. With the average particle diameter being 70 μm or less, when the obtained compact is used in a magnetic core, the eddy current loss can be effectively reduced even in the case of employing the magnetic core at high frequencies of 1 kHz or higher. When the average particle diameter is 50 μm or more, it is easier to not only obtain the effect of reducing the hysteresis loss, but also to handle the powder. The term "average particle diameter" implies the diameter of the particle at which, in a histogram of particle diameter, the sum of weights of particles counting from the minimum-size particle reaches 50% of total mass of all the particles, i.e., 50% particle diameter (mass).

An appropriate insulating material having good insulation property can be used for the insulating coating. Examples of the insulating material include a metal oxide, a metal nitride, and a metal carbide, such as an oxide, a nitride, and a carbide of one or more types of meal elements selected from among Fe, Al, Ca, Mn, Zn, Mg, V, Cr, Y, Ba, Sr, and rare earth elements (except for Y). Other examples of the insulating material include one or more types of compounds selected from other compounds, such as a phosphorous compound, a silicon compound, a zirconium compound, and an aluminum compound, than the above-mentioned metal oxide, metal nitride, and metal carbide. Still other examples of the insulating material include a metallic phosphate compound (typically iron phosphate, manganese phosphate, zinc phosphate, calcium phosphate, etc.), a metallic borate compound, a metallic silicate compound, and a metallic titanate compound. In particular, the metallic phosphate compound has good deformability. Thus, the insulating coating made of the metallic phosphate compound is easily deformable following deformation of the soft magnetic particle and is less susceptible to damage during compression molding. By employing the powder having that type of insulating coating, therefore, it is easier to obtain the compact in which the insulating coating is present in a sound state. Moreover, the insulating coating made of the metallic phosphate compound has high adhesion with respect to the soft magnetic particle made of the iron-based material, and is harder to peel off from the particle surface.

Other examples of the insulating material than mentioned above include resins such as a thermoplastic resin and a non-thermoplastic resin, and higher fatty acid salts. In particular, a silicon-based organic compound, such as a silicone resin, has good heat resistance and is less susceptible to decomposition even when the heat treatment is carried out on the obtained compression-molded product.

The insulating coating can be formed by utilizing chemical conversion treatment, e.g., phosphate chemical conversion treatment. Spraying of a solvent and a sol-gel process utilizing a precursor can also be used to form the insulating coating.

When the insulating coating is formed using the silicone-based organic compound, a wet coating process using an organic solvent, a direct coating process using a mixer, etc. can be employed.

The thickness of the insulating coating formed over the soft magnetic particle is 10 nm or more and 1 μm or less. With the thickness being 10 nm or more, insulation between the soft magnetic particles can be ensured. With the thickness being 1 μm or less, reduction in a proportion of a magnetic component in the compact due to the present of the insulating coating can be suppressed. In other words, when the magnetic core is fabricated using the compact satisfying such a condition, significant reduction of magnetic flux density can be suppressed. Here, the thickness of the insulating coating implies an average thickness that is determined by deriving an equivalent thickness in consideration of a film composition obtained with a composition analysis (using an analyzer TEM-EDX based on a transmission electron microscope and an energy dispersion X-ray spectroscopy) and the element content obtained with an inductively-coupled mass spectrometer (ICP-MS), and by directly observing the insulating coating on a TEM photo to confirm that the derived equivalent thickness is a proper value.

A lubricant may be added to the material powder described above. The lubricant may be, e.g., not only a solid lubricant made of an organic substance, but also an inorganic substance, such as boron nitride or graphite.

By employing the material powder described above, the compact 10 can be obtained which is made of coated particles, i.e., soft magnetic particles made of the above-mentioned soft magnetic material, and which includes, on the outer peripheries of the soft magnetic particles, the insulating coatings made of the above-mentioned insulating material (including the insulating material modified by the heat treatment).

Advantageous Effects

Since the compact 10 includes, as the main body, the frustum portion 113 having a cross-section in the form of the trapezoidal surface 113*s*, and a surface (outer peripheral surface 113*o*) in sliding contact with the forming mold (specifically, the inner peripheral surface of the die) is inclined relative to the direction in which the compression-molded product is drawn out, the friction caused by the sliding contact can be effectively reduced. Accordingly, the compression-molded product can be easily drawn out from the forming mold. Moreover, in the coated soft magnetic particles constituting the outer peripheral surface and thereabout of the compression-molded product having been drawn out, the damage of the insulating coatings is reduced because of the reduction of the above-described friction, and the generation of the portions where the adjacent soft magnetic particles come into an electrically conductive state due to plastic deformations thereof, i.e., the bridge portions, is suppressed. Accordingly, when the post-treatment is carried out on the compression-molded product to remove the bridge portions, a treatment time can be shortened, and an amount of the bridge portions to be removed can be reduced. As a result, the compact 10 has good productivity.

Furthermore, the compact 10 is expected to provide a magnetic core exhibiting a low loss not only in the case of carrying out the post-treatment described above, but also in the case of employing, as a constituent element of the magnetic core, the compact in the state without carrying out the post-treatment because the damage of the insulating coatings and the generation of the bridge portions are suppressed.

Since the friction between the compact 10 and the forming mold 100 is reduced, the longer lifetime of the mold is also expectable. In addition, since, in the through-hole 103*h* of the die 103, the opening through which the upper punch 101 is inserted is larger the opening through which the lower punch 102 is inserted, air between the coated magnetic particles can more easily escape after supply of the material powder, and shortening of a degassing time is expected. Those points also contribute to giving the compact 10 with good productivity.

Embodiment 2

Figure 3:
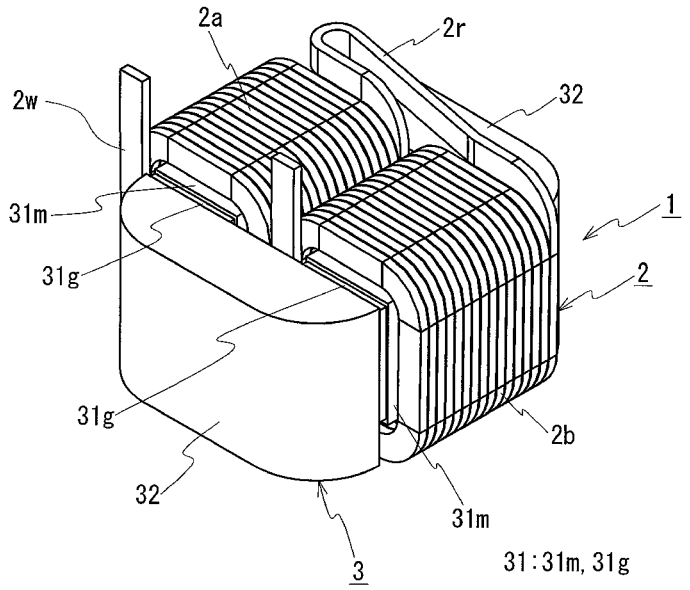
FIG. 3 is an outline perspective view of a reactor of Embodiment 2.
Figure 4:
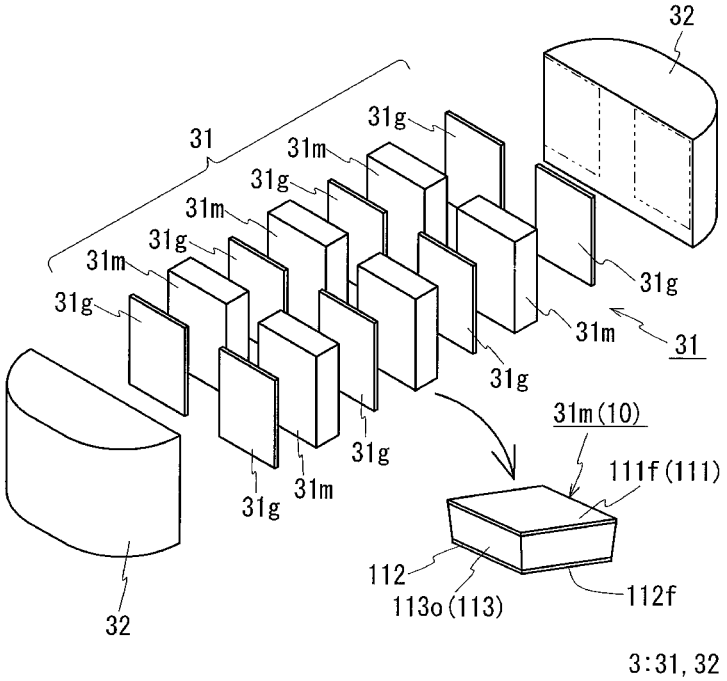
FIG. 4 is an exploded perspective view of a magnetic core disposed in the reactor of Embodiment 2.

As one example of a magnetic circuit component according to the present invention, a reactor will be described below with reference to FIGS. 3 and 4.

A reactor 1 includes a coil 2 having a pair of tubular coil elements 2*a* and 2*b*, and a magnetic core 3 that forms a closed magnetic path when the coil 2 is excited. The magnetic core 3 includes a pair of columnar inner core portions 31 that are inserted in the coil elements 2*a* and 2*b*, respectively, and exposed core portions 32 that are exposed from the coil 2 and that couple the pair of inner core portions 31 to constitute an annular member. The magnetic core 3 is mainly constituted by a plurality of core pieces each formed of a compact. The reactor 1 is featured in that the core pieces constituting the inner core portions 31 are each formed of the compact 10 according to Embodiment 1.

It is to be noted that the other structure than the core pieces constituting the inner core portions 31 can be realized using the structure of a known reactor, and that the structures illustrated in FIGS. 3 and 4 and the structures described below merely represent one example.

(Coil)

The coil 2 includes the pair of coil elements 2*a* and 2*b* each of which is formed by spirally winding one continuous wire 2*w* having no joints, and a coupling portion 2*r* that couples both the coil elements 2*a* and 2*b* to each other. The coil elements 2*a* and 2*b* are hollow tubular members having the same number of windings, and are arranged in parallel (side by side) with their axial directions being parallel to each other. At the other end side (right side in FIG. 3) of the coil 2, a part of the wire 2*w* is bent into a U-like shape to form the coupling portion 2*r*. With such an arrangement, winding directions of both the coil elements 2*a* and 2*b* are made the same.

The wire 2*w* is suitably provided by a coated wire in which an insulating layer made of an insulating material (typically, an enamel layer made of, e.g., polyamide-imide) is covered on an outer periphery of a conductor made of an electroconductive material, e.g., copper, aluminum, or an alloy thereof. The conductor of the wire 2*w* is suitably provided by a round wire having a circular cross-section, or a rectangular wire having a rectangular cross-section. The coil elements 2*a* and 2*b* are each an edgewise coil that is formed by edgewise-winding a coated rectangular wire having an insulating layer.

(Magnetic Core)

The magnetic core 3 is described below with reference to FIG. 4. The magnetic core 3 includes the pair of columnar inner core portions 31 which are covered with the coil elements 2*a* and 2*b* (FIG. 3), respectively, and the pair of exposed core portions 32 that are exposed from the coil 2 instead of being covered with the coil 2 (FIG. 3). The inner core portions 31 are each a columnar member (substantially a rectangular parallelepiped herein) that has an outer profile following the inner peripheral shape of the corresponding coil element 2*a* or 2*b*, and the exposed core portions 32 are each a columnar member having a pair of trapezoidal surfaces. The magnetic core 3 is formed in an annular shape by arranging the exposed core portions 32 to sandwich the inner core portions 31, arranged in spaced relation, between them, and by contacting opposite end surfaces of each inner core portion 31 with respective inner end surfaces of the exposed core portions 32.

The inner core portions 31 are each a laminate that is constituted by alternately stacking a core piece 31*m* made of a magnetic material, and a gap member 31*g* made of a material having lower magnetic permeability than the core piece, typically a nonmagnetic material. The exposed core portions 32 are also each a core piece made of a magnetic material.

The gap member 31*g* is a member disposed for adjustment of inductance. Examples of practical materials for the gap member 31*g* include not only alumina, a glass epoxy resin, and unsaturated polyester (each being a nonmagnetic material), but also a mixed material containing magnetic powder (e.g., ferrite, Fe, Fe—Si, or sendust) dispersed in a nonmagnetic material, such as a ceramic or a phenol resin.

For example, an adhesive or an adhesive tape can be used to integrate the adjacent core pieces and to integrate the core piece 31*m* and the gap member 31*g* with each other. In one case, the adhesive tape may be used to form the inner core portion 31, and the adhesive may be used to join the inner core portion 31 and the exposed core portion 32 to each other.

The core pieces 31*m* in the inner core portion 31 are each constituted by the compact 10 described in Embodiment 1. In particular, the core pieces 31*m* constituting the inner core portion 31 are arranged such that (see FIG. 1C) the outer peripheral surface 1130 of the frustum portion 113 of each compact 10 (core piece 31*m*) and the outer peripheral surfaces of the plate-shaped portions 111 and 112 thereof are positioned to face inner peripheral surfaces of the coil elements 2*a* and 2*b* (FIG. 3). Stated in another way, the core pieces 31*m* constituting the inner core portion 31 are inserted and arranged in the coil elements 2*a* and 2*b* such that the press-molded surfaces 111*f* and 112*f* of the plate-shaped portions 111 and 112 of the compact 10 (core piece 31*m*) are positioned perpendicularly to the axial direction of the coil elements 2*a* and 2*b*. Accordingly, the outer peripheral surface 113*o* of the frustum portion 113 is arranged to intersect the direction of magnetic fluxes produced by the coil elements 2*a* and 2*b* at the taper angle θ when the coil 2 is excited. When cutting the inner core portion 31 along a plane perpendicular to the direction of magnetic fluxes in the state where the inner core portion 31 is arranged as described above, there is a portion (frustum portion 113) having a cross-sectional area different depending on a cut position. However, when the taper angle θ and the area ratio are held within the above-described particular ranges, especially when the taper angle θ is sufficiently small and the area ratio is sufficiently large, the outer peripheral surface 113*o* of the frustum portion 113 is arranged substantially parallel to the direction of magnetic fluxes. The gap member 31*g* is arranged in contact with the plate-shaped portion 111 or 112 of the compact 10 (core piece 31*m*).

(Other Constituent Members)

Additionally, an insulator made of an insulating resin may be provided to increase insulation between the coil 2 and the magnetic core 3. It is also possible to cover an outer periphery of an assembly of the coil 2 and the magnetic core 3 with an insulating resin, thus forming an integral unit, to contain the assembly in a case made of a metal material, for example, or to cover the assembly, contained in the case, with a sealing resin.

Advantageous Effects

In the reactor 1, the compact 10 is used as a constituent element of the magnetic core 3, particularly in a portion (inner core portion 31) that is contained in the coil 2. Since the constituent element used in such a portion, i.e., the compact 10, has good productivity, the reactor 1 also has good productivity in itself. Moreover, as seen from test examples described later, the reactor 1 exhibits a low loss by employing the low-loss compact 10 as the constituent element of the magnetic core 3, particularly in the portion (inner core portion 31) that is contained in the coil 2, i.e., in a portion where the eddy current loss tends to generate.

[Modifications]

Embodiment 2 has been described in connection with the reactor including one pair of coil elements. The reactor may have another form comprising one tubular coil and a magnetic core that includes a columnar inner core portion arranged in the tubular coil, an outer peripheral core portion arranged around the tubular coil, and end surface core portions arranged at end surfaces of the tubular coil in opposing relation and coupling the inner core portion and the outer peripheral core portion to each other. In such a form, the outer peripheral core portion and the end surface core portions serve as exposed core portions. Typical examples of the above-mentioned form include the so-called E-I form, E-E form, and pot form, which are constituted by combining the ER-type core, the E-type core and the I-type core.

In one form of the above-described modification, as in the reactor 1 of Embodiment 2, a magnetic core is constituted by a combination of plural core pieces, and the compact 10 of Embodiment 1 is used as the core pieces constituting at least the inner core portion. By employing such a form, the reactor including the low-loss magnetic core can be manufactured with good productivity because the compact 10 of Embodiment 1 is used as the constituent element in the inner core portion.

Alternatively, the magnetic core may have a form including an integrally molded ER-type core or E-type core, or a form including an integrally molded T-type core and ]-shaped core. For example, as illustrated in a portion (A) of FIG. 6, the ER-type core can be obtained by employing a compact 11 in which central one of three legs of the ER-type core, which one is arranged in a tubular coil, includes a frustum portion 113 having a trapezoidal sectional surface as in the compact 10 of Embodiment 1, when looking at a cross-section of the central leg taken in the axial direction of the tubular coil. The compact 11 includes the frustum portion 113, a ]-shaped portion coupled to a long-end side of the frustum portion 113, and a plate-shaped portion 112 coupled to the short-end side of the frustum portion 113 and having a rectangular sectional surface in the above-mentioned cross-section. The ]-shaped piece includes a part having a rectangular shape in the above-mentioned cross-section, and the relevant part can be regarded as a plate-shaped portion 111 (however, it is assumed that when cutting the three legs in the above-mentioned cross-section along an extension line of a long side of the trapezoidal surface and omitting two legs on both sides, the compact 11 satisfies a condition of (an area S1 of a long-side rectangular surface constituting the plate-shaped portion 111+an area S2 of a short-side rectangular surface constituting the plate-shaped portion 112<an area S3 of the trapezoidal surface constituting the frustum portion 113)). The compact 11 is a solid body in which two opposing sides of the cross-section (long-side rectangular surface) of the plate-shaped portion 111 are longer than the long side of the cross-section (trapezoidal surface) of the frustum portion 113, and two opposing sides of the cross-section (short-side rectangular surface) of the plate-shaped portion 112 are equal to the short side of the cross-section (trapezoidal surface) of the frustum portion 113. In the compact 11, a ratio of the area of a boundary surface between the frustum portion 113 (trapezoidal surface) and the plate-shaped portion 112 (short-side rectangular surface) to the area of a boundary surface between the frustum portion 113 (trapezoidal surface) and the plate-shaped portion 111 (long-side rectangular surface) also preferably satisfies 80% to 99.8%.

Figure 7:
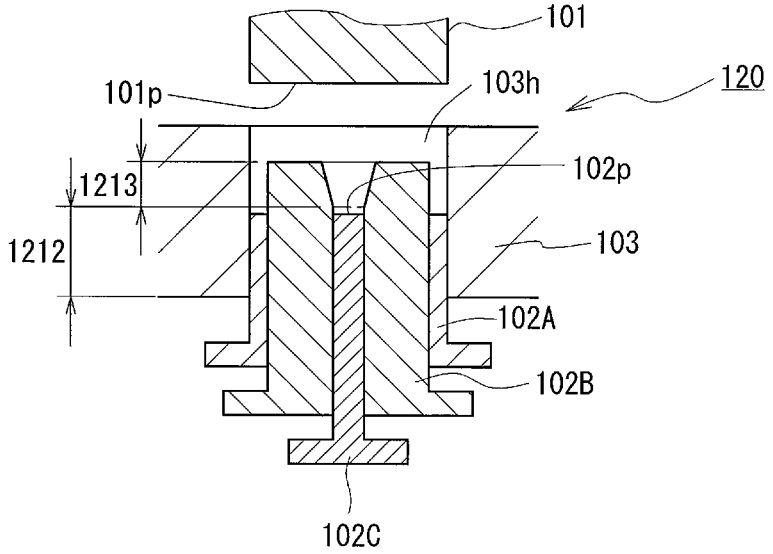
FIG. 7 is an explanatory view to explain one example of a forming mold used in manufacturing the compact employed in the ER-type core.

The compact 11 can be formed, for example, by employing a forming mold 120 illustrated in FIG. 7. The forming mold 120 includes a die 103 having a through-hole 103*h* defined by a flat surface, lower punches 102A to 102C forming a columnar punch when combined together, and a columnar upper punch 101. A through-hole of the tubular lower punch 102B has a tapered portion 1213, which is similar to the tapered portion 1013 of the die 103 in the above-described forming mold 100, in its region close to the upper punch 101, and a linear portion 1212 joining to the tapered portion 1213. A peripheral edge of the tapered portion 1213 of the lower punch 102B defines an opening of the through-hole of the lower punch 102B. An end surface (pressing surface 102*p*) of the columnar lower punch 102C is inserted into the through-hole of the tubular lower punch 102B, and the lower punch 102C is arranged such that the pressing surface 102*p* is positioned near an upper end of the linear portion 1212. With such an arrangement, the lower punches 102B and 102C can define, as illustrated in FIG. 7, a region having a trapezoidal sectional surface, and a region being adjacent to a short side of the trapezoidal sectional surface of the above-mentioned region and having a rectangular sectional surface. By inserting the lower punches 102A to 102C into the through-hole 103*h* of the die 103 and arranging the lower punches as illustrated in FIG. 7, a molding space having an E-shape in a cross-section can be formed. The compact 11 is obtained by filling material powder (not illustrated) into the molding space, which is defined by the end surface of the lower punch 102A, the pressing surface 102*p* of the lower punch 102C, and the end surface and the peripheral surface of the lower punch 102B, and by compression-molding the material powder with the pressing surfaces 101*p* and 102*p*. The surface of the plate-shaped portion 111 of the compact 11 and the surface of the ]-shaped portion parallel to the surface of the plate-shaped portion 112 are press-molded surfaces 111*f* and 112*f*, which are perpendicular to a pressing direction during the molding. When a coil is arranged around the frustum portion 113, the pressing direction during the molding of the compact 11 is aligned with the axial direction of the coil. The surface (press-molded surface 111*f*) of the ]-shaped portion of the compact 11, which is parallel to the surface of the plate-shaped portion 112, is a surface that is positioned at the leading end side in a direction of drawing-out of the compact 11 from the forming mold 120.

Figure 8:
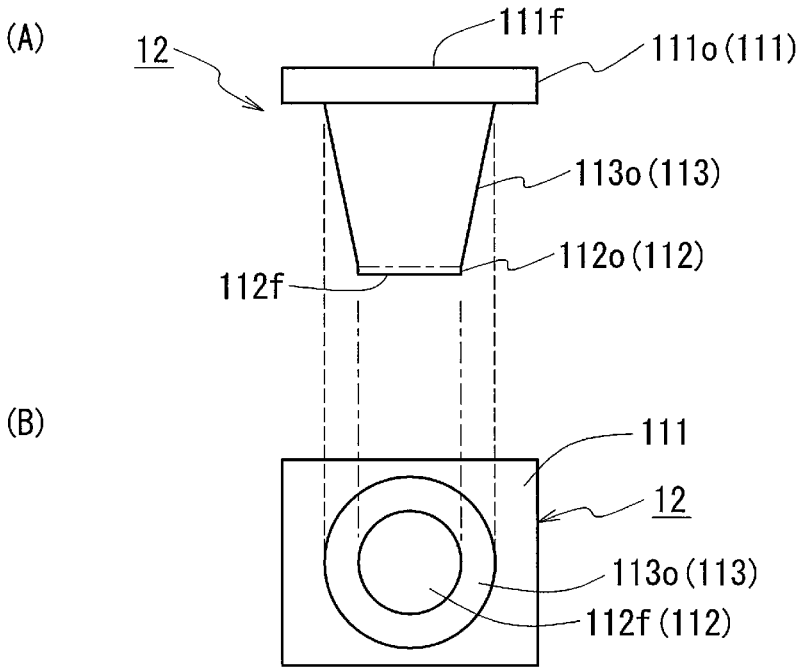
FIG. 8 consists of a portion (A) representing a front view of a compact employed in a T-type core, and a portion (B) representing a rear view of the compact.

As illustrated in FIG. 8, the T-type core can be obtained by employing a compact 12 that includes a frustum portion 113 having a trapezoidal sectional surface (e.g., in a cross-section taken in the axial direction of the coil) as in the compact 10 of Embodiment 1. The compact 12 includes the frustum portion 113, a plate-shaped portion 111 coupled to a long side of the frustum portion 113 and having a rectangular sectional surface in the above-mentioned cross-section, and a plate-shaped portion 112 coupled to a short side of the frustum portion 113 and having a rectangular sectional surface in the above-mentioned cross-section. The plate-shaped portion 111 is projecting from a peripheral edge of the frustum portion 113. Accordingly, when looking at the compact 12 in the above-mentioned cross-section, a long-side rectangular surface constituting the plate-shaped portion 111 is joined to an extension line of the long side of the trapezoidal surface. In other words, the compact 12 is also a solid body in which two opposing sides of the cross-section (long-side rectangular surface) of the plate-shaped portion 111 are longer than the long side of the cross-section (trapezoidal surface) of the frustum portion 113, and two opposing sides of the cross-section (short-side rectangular surface) of the plate-shaped portion 112 are equal to the short side of the cross-section (trapezoidal surface) of the frustum portion 113. The compact 12 satisfies a condition of (an area S1 of the long-side rectangular surface constituting the plate-shaped portion 111+an area S2 of the short-side rectangular surface constituting the plate-shaped portion 112<an area S3 of the trapezoidal surface constituting the frustum portion 113). In the compact 12, a ratio of the area of a boundary surface between the frustum portion 113 (trapezoidal surface) and the plate-shaped portion 112 (short-side rectangular surface) to the area of a boundary surface between the frustum portion 113 (trapezoidal surface) and the plate-shaped portion 111 (long-side rectangular surface) is also preferably 80% to 99.8%. The above-mentioned T-type core can be employed, for example, as a motor core as well.

Figure 9A:
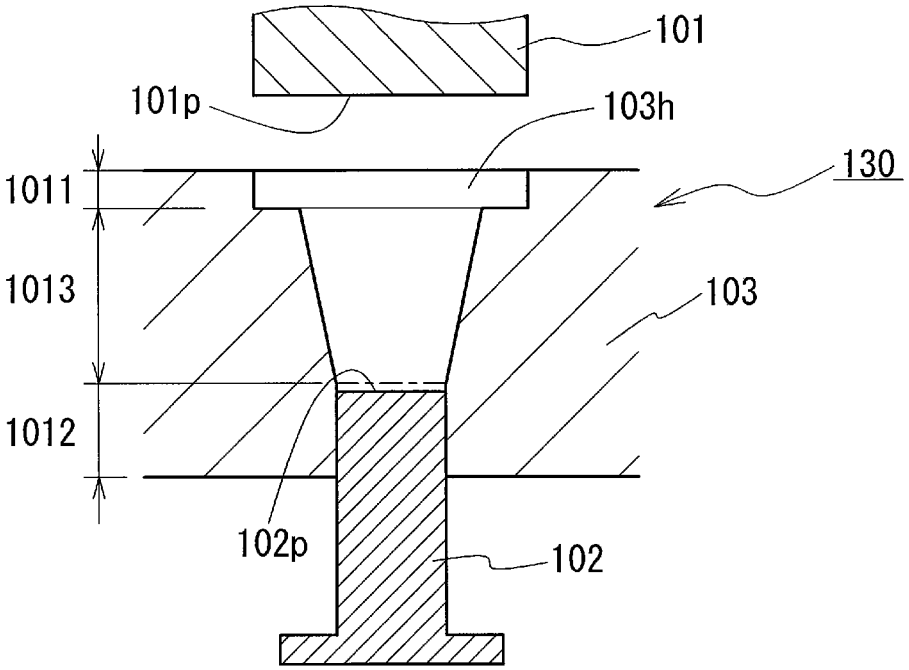
FIG. 9A is an explanatory view to explain one example of a forming mold used in manufacturing a compact employed in a T-type core.

The compact 12 can be formed, for example, by employing a forming mold 130 illustrated in FIG. 9A. The forming mold 130 is substantially similar to the forming mold 100 in Embodiment 1, and it includes an upper punch 101, a lower punch 102, and a die 103 having a through-hole 103*h*. The die 103 includes a tapered portion 1013 and linear portions 1011 and 1012. However, the die 103 has a stepped shape in its region close to an opening thereof, and the linear portion 1011 is formed to project from a peripheral edge of the tapered portion 1013 on the side closer to the upper punch 101 in a direction perpendicular to an axis of the through-hole 103*h*. By employing the die 103 having such a stepped groove, the compact 12 can be molded which includes the plate-shaped portion 111 projecting from the frustum portion 113 as described above. The height (depth) of the linear portion 1011 (stepped groove) and a distance through which the upper punch 101 is inserted into the die 103 are preferably selected such that an area S1 of the long-side rectangular surface takes a desired value.

Figure 9B:
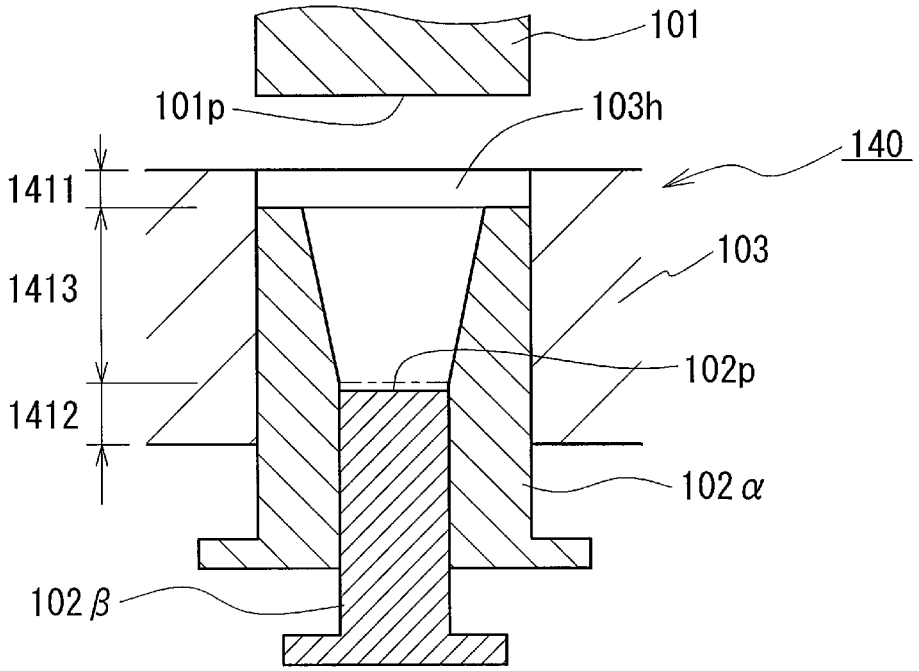
FIG. 9B is an explanatory view to explain one example of a forming mold used in manufacturing the compact employed in the T-type core.

Alternatively, the compact 12 can also be formed, for example, by employing a forming mold 140 illustrated in FIG. 9B. The forming mold 140 includes a die 103 having a through-hole 103*h* defined by a flat surface, a tubular lower punch 102α and a columnar lower punch 102β both arranged in concentric relation, and a columnar upper punch 101. A through-hole of the tubular lower punch 102α has a tapered portion 1413, which is similar to the tapered portion 1013 of the die 103 in the above-described forming mold 100, in its region close to the upper punch 101, and a linear portion 1412 joining to the tapered portion 1413. A peripheral edge of the tapered portion 1413 of the lower punch 102α defines an opening of the through-hole of the lower punch 102α. An end surface (pressing surface 102*p*) of the columnar lower punch 102β is inserted into the through-hole of the tubular lower punch 102α, and the lower punches 102α and 102β are arranged such that the pressing surface 102*p* is positioned midway the linear portion 1412. With such an arrangement, the lower punches 102α and 102β can define, as illustrated in FIG. 9B, a region having a trapezoidal sectional surface, and a region being adjacent to a short side of the trapezoidal sectional surface of the above-mentioned region and having a rectangular sectional surface. By inserting and arranging the lower punches 102α and 102β in the through-hole 103*h* of the die 103, a linear portion 1411 is defined by the end surface of the lower punch 102α (i.e., the surface of the lower punch 102α opposing to the upper punch 101) and the through-hole 103*h* of the die 103. Thus, a molding space having a T-shape in a cross-section can be formed.

Reference Example

A compact including a particular frustum portion and a solid body, which has a press-molded surface and which is positioned adjacent to the frustum portion, exhibits a low loss and good productivity similarly to the above-described compact 10 of Embodiment 1, etc., even in the case of (the area S1 of the long-side rectangular surface constituting the plate-shaped portion 111+the area S2 of the short-side rectangular surface constituting the plate-shaped portion 112≥the area S3 of the trapezoidal surface constituting the frustum portion 113). In one form, such a compact is formed by compression-molding coated soft magnetic particles covered with insulating coatings, the compact comprising:

an inner portion arranged in a tubular coil, a first portion being adjacent to the inner portion and having a first surface that constitutes an outer surface of the compression-molded product, and a second portion being adjacent to the inner portion and having a second surface that constitutes an outer surface of the compression-molded product and that is positioned in opposing relation to the first surface, wherein, when looking at a cross-section of the inner portion taken in an axial direction of the coil, a boundary line between the inner portion and the first portion is longer than a boundary line between the inner portion and the second portion, a ratio of an area of a boundary surface between the inner portion and the second portion to an area of a boundary surface between the inner portion and the first portion is 80% or more and 99.8% or less, the compact is molded with the axial direction of the coil being a pressing direction during the molding, and the first surface is positioned on the leading end side in a direction in which the compact is drawn out from a forming mold.

In the above-described form, since the axial direction of the coil is the pressing direction during the molding, the first surface and the second surface become press-molded surfaces. In the above-described form, typically, the inner portion is a frustum body, and the first portion and the second portion are each a columnar solid body, e.g., a rectangular parallelepiped or a circular column, similarly to the plate-shaped portion described above. In a more practical form, the compact is, for example, the above-described E-type core, ER-type core, T-type core in which the long-side rectangular surface is larger than the trapezoidal surface.

Test Examples

Compacts were fabricated, and reactors were fabricated using the obtained compacts. An eddy current loss of each reactor was examined. A treatment time of the post-treatment and an amount of wear of a forming mold were also examined.

In tests, as samples No. 1, plural compacts each having a shape of a modified frustum of quadrangular pyramid, including a frustum portion as a main body and plate-shaped portions arranged in opposing relation, were fabricated by employing the forming mold 100 (in which the through-hole 103*h* of the die 103 had the tapered portion 1013) illustrated in FIGS. 2A and 2B. As samples No. 100, plural compacts, each having a rectangular parallelepiped shape, were fabricated by employing another forming mold. In the forming mold used to fabricate each sample No. 100, a through-hole of a die had a rectangular parallelepiped shape; namely, it had a uniform area over a region from one opening to the other opening thereof. Each sample was cold-molded under molding pressure of 7 ton/cm$^2$ (≈690 MPa).

As material powder for each sample, coated powder was prepared which was made of a coated soft magnetic particle formed by covering pure iron power (average particle diameter: 50 μm), manufactured by a water atomization method, with an insulating coating (thickness: about 20 nm or less) made of a metal phosphate compound through a chemical conversion process. In the tests, the material powder for each sample was mixed powder prepared by mixing powder of zinc stearate to the above-mentioned coated powder (amount of zinc stearate mixed: 0.6% by mass with respect to the total mixed powder).

A compression-molded product of each of the samples No. 1 and 100, drawn out from the die, was subjected to heat treatment (400° C.×30 min under a nitrogen atmosphere), whereby a heat-treated product was obtained. Dimensions of the heat-treated product (one form of the compact) thus obtained as each of the samples No. 1 and 100 were measured.

In the compact of each sample No. 1, the area of the press-molded surface of one plate-shaped portion is 40 mm×20 mm, the area of the press-molded surface of the other plate-shaped portion is 39.9 mm×19.9 mm, the thickness of each plate-shaped portion is 1 mm, the thickness of the frustum portion is 10 mm, the taper angle is about 0.29°, and the area ratio (39.9 mm×19.9 mm/40 mm×20 mm) is about 99.3%. Here, the area of the press-molded surface is equal to that of the boundary surface between the plate-shaped portion and the frustum portion. In a cross-section (vertical cross-section) cutting the compact in a direction perpendicular to the press-molded surface, the area of the trapezoidal surface constituting the frustum portion, i.e., 399.5 mm$^2$, is sufficiently larger than the total area of the long-side rectangular surface and the short-side rectangular surface both joining to the trapezoidal surface and constituting the respective plate-shaped portions, i.e., 40+39.9=79.9 mm$^2$, and an area rate of the trapezoidal surface occupying in the above-mentioned cross-section is about 83%. In another vertical cross-section, the area of the trapezoidal surface, i.e., 199.5 mm$^2$, is sufficiently larger than the total area of the long-side rectangular surface and the short-side rectangular surface both joining to the trapezoidal surface and constituting the respective plate-shaped portions, i.e., 20+19.9=39.9 mm$^2$, and an area rate of the trapezoidal surface occupying in the above-mentioned cross-section is about 83%.

The compact 10 of each sample No. 100 is a rectangular parallelepiped having a pair of press-molded surfaces each having the same size, i.e., 40 mm×20 mm, as that of the one plate-shaped portion of the sample No. 1, and having the same thickness, i.e., 12 mm, as the total thickness of the compact of the sample No. 1.

Post-treatment was performed on each heat-treated product obtained as described above. The post-treatment was made by etching a surface of each heat-treated product, the surface having been formed by the inner peripheral surface of the die, (i.e., outer peripheral surfaces of the plate-shaped portions and the frustum portion in the sample No. 1 or outer peripheral surfaces joining to the pair of press-molded surfaces in the sample No. 100) with hydrochloric acid (concentration: 35% by mass).

As for each of the samples No. 1 and 100, a measurement object (corresponding to a reactor) was fabricated by preparing plural post-treated products after being subjected to the post-treatment, combining the post-treated products into an annular form to set up a magnetic core for testing, and arranging each of wire coils (having the same specifications in all the tests) around the magnetic core for testing. In the test, the reactor including the pair of coil elements, described in Embodiment 2, was fabricated. In more detail, as for each sample, the inner core portion was fabricated using the plural post-treated products, and inserting and arranging the fabricated inner core portion in each of the coil elements such that the heat-treated surfaces (i.e., the outer peripheral surfaces of the plate-shaped portions and the frustum portion in the sample No. 1 or the outer peripheral surfaces joining to the pair of press-molded surfaces in the sample No. 100) were each positioned to face the corresponding inner peripheral surface of the coil element (see FIG. 1C). Exposed core portions and gap members having the same specifications were used in the samples No. 1 and 100. The reactor thus obtained was measured for an eddy current loss We (W) at excitation magnetic flux density Bm of 1 kG (=0.1 T) and measurement frequency of 5 kHz by employing an AC-BH curve tracer. Table 1 lists the measured results. The evaluation was performed on the samples No. 1 and 100 by fabricating post-treated products with the treatment time (etching time) of the above-described post-treatment set to the same time, and by fabricating each reactor using those post-treated products.

Furthermore, the treatment time of the post-treatment necessary for reducing the eddy current loss and satisfying a predetermined value was examined. Table 1 also lists the examined results. The evaluation was performed by fabricating reactors using post-treated products having been subjected to the post-treatment for various treatment times as described above, measuring the eddy current loss of each reactor, and determining the treatment time at which the post-treated product with the eddy current loss satisfying the predetermined value was obtained.

Moreover, an amount of wear of the molding die after continuously molding the above-described compression-molded products was examined. Table 1 further lists the examined results of the wear amount. In the test, the wear amount was determined by setting, as a measurement region, the following location in the inner peripheral surface of the die, and by measuring a contour shape (profile) of the measurement region with a three-dimensional profile and form tester. The measurement region was set to a location contacting with a central portion of an outer peripheral surface of the compression-molded product in the direction of thickness thereof, which was molded in a state where the material powder was completely compressed. A different between the contour shape of the measurement region before the molding and the contour shape of the measurement region after molding 20,000 pieces of compression-molded products was examined, and a maximum value of the difference was regarded as the wear amount (wear amount of the mold).

TABLE 1

| Sample No. | Eddy current loss (W) | Treatment time (min) | Wear amount of mold (μm) |
|---|---|---|---|
| 1 | 15 | 10 | 1 |
| 100 | 25 | 15 | 4 |

As seen from Table 1, the sample No. 1 corresponding to the compact having the particular shape exhibits a smaller eddy current loss than the sample No. 100 in spite of the post-treatment time being shorter. It can therefore be said that the reactor using the sample No. 1 exhibits a small loss and good high-frequency characteristics even when used at high frequencies. The reason presumably resides in that, in the compression-molded product of the sample No. 1, because the friction between the compact and the inner peripheral surface of the die is reduced, the damage of the insulating coatings of the coated soft magnetic particles and the generation of the bridge portions are suppressed, and insulation between the soft magnetic particles is sufficiently ensured. It is also seen that, by employing the compact having the particular shape, a reactor exhibiting a smaller eddy current loss can be obtained when the post-treatment time is set to the same value. The reason is presumably as follows. In the compression-molded product of the sample No. 1, the bridge portions are not generated in the deep inside thereof, and the bridge portions generated in a surface portion are sufficiently removed, while the damage of the insulating coatings is suppressed as described above. As a result, the insulation between the soft magnetic particles can be sufficiently ensured. It is further seen that, by employing the compact having the particular shape, the wear of the forming mold can be reduced, and the lifetime of the mold can be prolonged. The reason presumably resides in the above-described reduction of the wear.

Thus, it can be said that the compact of the present invention, which includes a portion mainly constituted by a solid body (frustum body) having a trapezoidal shape in a cross-section, and the reactor core of the present invention, the core including the inventive compact, have good productivity and exhibit a low loss when utilized as a constituent element of a magnetic core in a reactor. It can also be said that the magnetic circuit component of the present invention, employing the inventive compact, exhibits a low loss and good productivity, because the constituent element of the magnetic core has good productivity and a low loss.

The present invention is not limited to the embodiments described above, and the present invention can be appropriately modified without departing from the gist of the present invention. For example, the material and the diameter of the soft magnetic particle, the material and the thickness of the insulating coating, the sizes (including the area ratio and the projection area) and the planar shapes of the trapezoidal surface and each rectangular surface, etc. may be modified as required.

INDUSTRIAL APPLICABILITY

The compact of the present invention can be suitably utilized as a constituent element of magnetic cores in various magnetic circuit components (such as a reactor, a transformer, a motor, and a choke coil), particularly a constituent element of a magnetic core required to exhibit good high-frequency characteristics. The magnetic circuit component of the present invention can be suitably utilized in various reactors (such as vehicle-loaded parts and parts of power generating and transforming installations). In particular, the magnetic circuit component of the present invention can be suitably utilized in a reactor included in a vehicle-loaded power device, e.g., a vehicular converter equipped in vehicles, such as a hybrid car, an electric car, and a fuel cell car. The reactor core of the present invention can be suitably utilized as a constituent element of a magnetic core in the magnetic circuit component of the present invention, such as the above-mentioned reactor.

The invention claimed is:

1. A compact being made of coated soft magnetic particles covered with insulating coatings, wherein the compact has, as a cross-section thereof, a surface comprising:

a trapezoidal surface having a long side and a short side opposing to each other;

a long-side rectangular surface joining to the long side of the trapezoidal surface; and a short-side rectangular surface joining to the short side of the trapezoidal surface, and wherein an area of the trapezoidal surface is larger than a total area of the long-side rectangular surface and the short-side rectangular surface and the long-side rectangular surface and the short-side rectangular surface each have a thickness of 0.3 to 2 mm.

2. The compact according to claim 1, wherein, assuming that a boundary surface between the trapezoidal surface and the long-side rectangular surface is a first surface and a boundary surface between the trapezoidal surface and the short-side rectangular surface is a second surface, the compact is molded such that a direction perpendicular to at least one of the first surface and the second surface is a pressing direction.

3. The compact according to claim 2, wherein a surface parallel to the first surface and a surface parallel to the second surface are both press-molded surfaces.

4. The compact according to claim 1, wherein, assuming that a boundary surface between the trapezoidal surface and the long-side rectangular surface is a first surface and a boundary surface between the trapezoidal surface and the short-side rectangular surface is a second surface, a ratio of an area of the second surface to an area of the first surface is 80% or more and 99.8% or less.

5. The compact according to claim 1, wherein a portion having the trapezoidal surface is employed at a location at which a tubular coil is arranged, and a surface constituting an oblique side of the trapezoidal surface is arranged to face an inner peripheral surface of the coil.

6. A reactor core including the compact according to claim 1.

7. A magnetic circuit component including a magnetic core and a tubular coil arranged in a part of the magnetic core, wherein the magnetic core includes an inner core portion arranged in the coil, and an exposed core portion exposed from the coil and forming a closed magnetic path in cooperation with the inner core portion, and the inner core portion includes the compact according to claim 1.

8. The magnetic circuit component according to claim 7, wherein the magnetic circuit component is a reactor.

* * * * *